US007408173B2

(12) United States Patent
Khalil

(10) Patent No.: US 7,408,173 B2
(45) Date of Patent: Aug. 5, 2008

(54) COLD ELECTRON EMITTER

(76) Inventor: Wesam Khalil, #102, 6990 134th Street, Surrey, BC (CA) V3W 4S9

( * ) Notice: Subject to any disclaimer, the term of this patent is extended or adjusted under 35 U.S.C. 154(b) by 266 days.

(21) Appl. No.: 11/152,049

(22) Filed: Jun. 15, 2005

(65) Prior Publication Data

US 2006/0284121 A1 Dec. 21, 2006

(51) Int. Cl.
*H01J 31/00* (2006.01)

(52) U.S. Cl. ..... 250/423 P; 250/214 VT

(58) Field of Classification Search ..... 250/423, 250/370.11, 214 VT, 200, 549, 207, 214 R, 250/423 P; 378/62, 98.2
See application file for complete search history.

(56) References Cited

U.S. PATENT DOCUMENTS 3,355,616 A * 11/1967 Hecker et al. ..... 313/377
4,286,148 A * 8/1981 Kamps et al. ..... 250/214 VT
4,339,659 A * 7/1982 Johnson ..... 250/214 VT
4,393,322 A * 7/1983 Siegmund ..... 313/544
4,413,280 A * 11/1983 Adlerstein et al. ..... 378/98.8
4,608,519 A 8/1986 Tosswill
4,691,099 A * 9/1987 Johnson ..... 250/214 VT
4,885,211 A * 12/1989 Tang et al. ..... 428/457
4,967,089 A * 10/1990 Reilly et al. ..... 250/493.1
5,049,753 A * 9/1991 Flesner ..... 250/396 R
5,336,888 A * 8/1994 Odom ..... 250/495.1
5,383,232 A * 1/1995 Gabbay et al. ..... 378/124
5,776,623 A * 7/1998 Hung et al. ..... 428/690
6,078,643 A * 6/2000 Vogelsong et al. ..... 378/98.2
6,653,547 B2 * 11/2003 Akamatsu ..... 136/205
6,765,347 B2 * 7/2004 Kusunoki et al. ..... 313/498
7,053,382 B2 * 5/2006 Noji et al. ..... 250/370.11
2001/0009970 A1 * 7/2001 Chornenky et al. ..... 600/3
2004/0140432 A1 * 7/2004 Maldonado et al. ..... 250/423 P
2004/0208281 A1 * 10/2004 Noji et al. ..... 378/62

FOREIGN PATENT DOCUMENTS

EP 0534547 A2 3/1993

OTHER PUBLICATIONS

Massey ("Laser photoelectron sources of high apparent brightness" IEEE Journal of Quantum Electronics vol. QE-20, No. 2. Feb. 1984.*
May, et al ("Picosecond photoelectron scanning electron microscope for noncontact testing of integrated circuits" Appl. Phys. Lett. 51(2) Jul. 13, 1987.*

* cited by examiner

*Primary Examiner*—Jack I. Berman
*Assistant Examiner*—Michael Maskell
(74) *Attorney, Agent, or Firm*—Stephen R. Burri

(57) ABSTRACT

An electron emitter provides a photocell having at least one photosensitive side, an electron accelerator, an electron collector disposed between the photosensitive side of the photocell and the electron accelerator, a non-metallic vacuum chamber having an adjustable vacuum containing the photocell, the electron accelerator and the electron collector; and a light source to excite electrons on the photosensitive side of the photocell. Upon light activation, infrared light strikes the photocell, causing electrons to be excited and released. The highly positively charged electron accelerator will attract the electrons under sufficient vacuum conditions. Some of the electrons travelling towards the electron accelerator will encounter the electron collector and be collected thereon. The device may be used as a rectifier or regulator to replace vacuum tubes such as for audio amplifiers and high voltage devices. It may also have application as an x-ray generator, an electron microscope or a display screen.

2 Claims, 5 Drawing Sheets

COLD ELECTRON EMITTER

TECHNICAL FIELD OF THE INVENTION

The present invention relates generally to electron emitters, and more particularly to a device for generating and collecting electrons emitted from a photocell exposed to light.

BACKGROUND OF THE INVENTION

Vacuum tubes are arrangements of electrodes in an envelope of glass or other material within which a vacuum has been applied. The electrodes are attached to leads passing through the envelope for connection to an electrical circuit. Simple vacuum tubes comprise a filament sealed in a glass envelope evacuated of all air. Upon heating of the filament by a process called thermionic emission, electrons are released form the filament. The released electrons, bearing a negative electrical charge, will move through the vacuum towards a positively-charged metal plate anode, resulting in a flow of electrons from the filament to the anode.

Vacuum tubes have been used for a wide variety of electronics applications, and are still used for specialised audio amplifiers. Vaccum tube principles are used in cathode ray tubes in televisions, oscilloscopes and computer monitors.

It is known to provide a device for x-ray imaging. An example of such a device includes U.S. patent application Ser. No. 10/795,414 by Kabushiki Kaisha Toshiba ("Toshiba"). The Toshiba patent describes an x-ray image tube device having a vacuum tube enclosing a main body. The main body has a photoelectric surface for converting light into electrons. Focusing electrodes along the length of the vacuum tube act as an electron accelerator and electron focuser directing electrons to an anode (electron collector) at the other end of the vacuum tube.

There are a number of desirable objectives in relation to electron emitters. Such electron emitters should ideally be able to operate without heating. They should be operable using a variety of electron activators, including various light sources. Existing electron emitters achieve some of these objectives, but with varying degrees of success.

It is an object of the present invention to provide a cold electron emitter in which electrons are released from a photocell upon activation by a light source. It is a further object of the present invention to provide such a device which is of simple architecture.

SUMMARY OF THE INVENTION

In one of its aspects, the invention comprises an electron emitter device comprising a photocell having at least one photosensitive side; an electron accelerator having a first adjustable potential difference applied thereto; an electron collector having a second adjustable potential difference applied thereto, the electron collector disposed between the photosensitive side of the photocell and the electron accelerator; a non-metallic vacuum chamber having an adjustable vacuum containing the photocell, the electron accelerator and the electron collector; and a light source positioned to provide light of a wavelength selected to excite electrons on the photosensitive side of the photocell.

In other aspects of the invention, the light source of the invention may be contained within the vacuum chamber and may provide light in the visible spectrum or infrared light.

In another of its aspects, the light source of the invention may be a light emitting diode.

In another of its aspects, the light source may be embedded within the photocell.

In yet another of its aspects, the dimensions of the electron collector may be selected such that a line between any point on the photocell and any point on the electron accelerator will pass through the electron collector.

In yet another of its aspects, the distance between the electron accelerator and the electron collector may be selected to optimize electrical current flow between the photocell and the electron collector.

In another of its aspects, the first adjustable potential difference accelerator voltage may be at least 12 KV when the vacuum does not exceed 23 inches of mercury vacuum ("HgV").

In yet another of its aspects, the first adjustable potential difference may be less than 12 KV and the vacuum may be greater than 23 inches HgV.

In another of its aspects, a glass plate may be disposed between and contiguous with the electron accelerator and the electron collector.

In another of its aspects, the electron accelerator may be a conductive transparent coating.

In another of its aspects, the coating may be manufactured of indium tin oxide.

In yet another of its aspects, the electron collector may comprise a phosphorous coating.

In another of its aspects, the electron collector may be manufactured of tungsten.

In another of its aspects, the electron collector may comprise a specimen to be examined by electron microscopy.

In another of its aspects, the distance between the electron collector and the photocell may be selected to optimize electrical current flow between the photocell and the electron collector.

In another of its aspects, an electron multiplier material may be disposed between and contiguous with the electron collector and the photocell.

In another of its aspects, the electron multiplier may comprise a microchannel plate.

In another embodiment of the invention, the invention may comprise an x-ray generating device comprising a photocell having at least one photosensitive side; an electron accelerator having a first adjustable potential difference applied thereto; an electron collector comprising tungsten having a second adjustable potential difference applied thereto, the electron collector disposed between the photosensitive side of the photocell and the electron accelerator; a vacuum chamber containing the photocell, the electron accelerator and the electron collector having a vacuum of at least 29 inches HgV; and a light source positioned to direct light to the photosensitive side of the photocell. In another embodiment of the invention, the invention may comprise an x-ray examining apparatus for medical diagnoses fitted with such an x-ray generating device.

In another embodiment of the invention, the invention may comprise an electron microscope electron generator comprising a photocell having at least one photosensitive side; an electron accelerator having an accelerator voltage connected thereto; a glass plate specimen receptacle disposed between the photosensitive side of the photocell and the electron accelerator; a vacuum chamber containing the photocell, the electron accelerator and the specimen receptacle having a vacuum of at least 29 inches HgV; and a light source positioned to direct light to the photosensitive side of the photocell.

In another embodiment of the invention, the invention may comprise a display screen device comprising a photocell having at least one photosensitive side; an electron accelerator having a first adjustable potential difference applied thereto; a display screen comprising a glass plate, the display screen disposed between the photosensitive side of the photocell and the electron accelerator and coated with phosphorous on the side facing the photocell having a second adjustable potential difference applied thereto; a vacuum chamber containing the photocell, the electron accelerator and the display screen having a vacuum of at least 29 inches HgV; and a light source positioned to direct light to the photosensitive side of the photocell.

In another embodiment of the invention, the invention may comprise a lithography device comprising a photocell having at least one photosensitive side; an electron accelerator having an accelerator voltage connected thereto; a silicone wafer having a second adjustable potential difference applied thereto, the silicon wafer disposed between the photosensitive side of the photocell and the electron accelerator; a vacuum chamber containing the photocell, the electron accelerator and the silicon wafer having a vacuum of at least 29 inches HgV; and a light source positioned to direct light to the photosensitive side of the photocell.

In another embodiment of the invention, the invention may comprise a vacuum tube comprising a photocell having at least one photosensitive side; an electron accelerator having an accelerator voltage connected thereto; an electron collector having a second adjustable potential difference applied thereto, the electron collector disposed between the photosensitive side of the photocell and the electron accelerator; a vacuum chamber containing the photocell, the electron accelerator and the electron collector having a vacuum of at least 29 inches HgV; and a light source positioned to direct light to the photosensitive side of the photocell.

Other aspects of the invention will be appreciated by reference to the description of the preferred embodiment which follows and to the claims.

BRIEF DESCRIPTION OF THE DRAWINGS

The invention will be described by reference to the preferred embodiment and the drawings thereof in which.

DETAILED DESCRIPTION OF BEST MODE AND PREFERRED EMBODIMENT OF THE INVENTION

Figure 1:
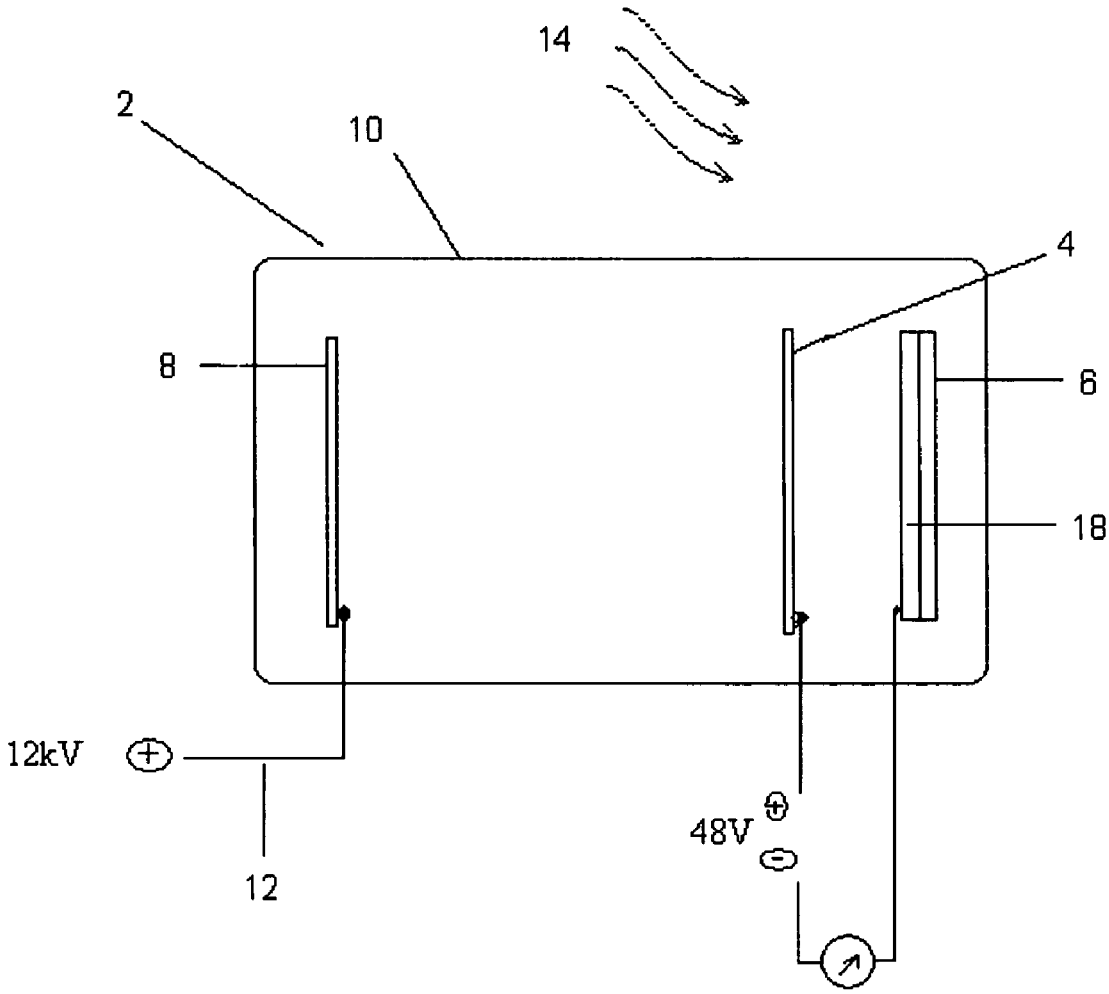
FIG. 1 is a schematic view of the electron emitter according to the invention.

As shown in FIG. 1, the cold electron emitter 2 according to the invention comprises a low-voltage metal plate electron collector 4 placed between a photocell 6 and a high-voltage metal plate electron accelerator 8, within a vacuum tube 10. A load 12 may be connected between the electron collector 4 and the photocell 6. In operation, light 14 from a light source such as a light emitting diode ("LED") strikes the photosensitive side 18 of the photocell, causing the emission of electrons from the surface of the photocell. With sufficient vacuum, the released electrons move in the direction of the electron accelerator 8 but are collected by the physically intervening electron collector 4.

In the preferred embodiment, a photocell comprising a semiconductor base sensitive to electromagnetic waves in the infrared range is contained within a vacuum tube. The light sensitive side of the photocell is connected to a negative voltage. A light source such as an infrared diode is positioned to face the light sensitive side of the photocell at an inclined angle, either inside the vacuum tube or outside of it. A first metal plate connected to a relatively high positive voltage is located within the vacuum enclosure a distance from and on the photosensitive side of the photocell and acts as an electron accelerator to attract electrons released from the photocell. Disposed between the first metal plate and the photocell within the vacuum tube is a second metal plate connected to a relatively low positive voltage, acting as an electron collector. An electronic circuit load may be connected between the photocell and the second metal plate.

Upon activation of the infrared source, infrared light is emitted which strikes the light sensitive side of the photocell, causing electrons to be excited and released from the photocell. The highly positively charged first metal plate electron accelerator will cause the released electrons to be accelerated toward it under sufficient vacuum conditions. Some of the electrons travelling towards the electron accelerator will encounter the second metal plate electron collector and be collected thereon.

In other embodiments, the device of the present invention may be used as a rectifier or regulator, able to replace vacuum tube in some of the applications where vacuum tubes are still in use, such as for audio amplifiers and high voltage devices. It may also have application as an x-ray generator, an electron microscope or a display screen.

With the use of tungsten as the metal of the electron collector, the device will function as an x-ray generator. Replacement of the electron collector metal plate with a glass plate to hold a specimen to be examined, will permit the technology to be used as an electron microscope.

By replacing the electron collector metal plate with a glass plate coated in a phosphorous layer, the device may be used as a display screen for televisions and computer monitors.

The device may incorporate an electron multiplier between the electron collector and the photocell, which may comprise a microchannel plate ("MCP"). An MCP is an array of tubes which amplifies electrons passing through tubes by secondary emission caused by released electrons striking the walls of the tubes and freeing additional electrons in a cascading pattern along the MCP.

Several experiments were carried out to determine the appropriate configuration of the present invention.

Figure 2:
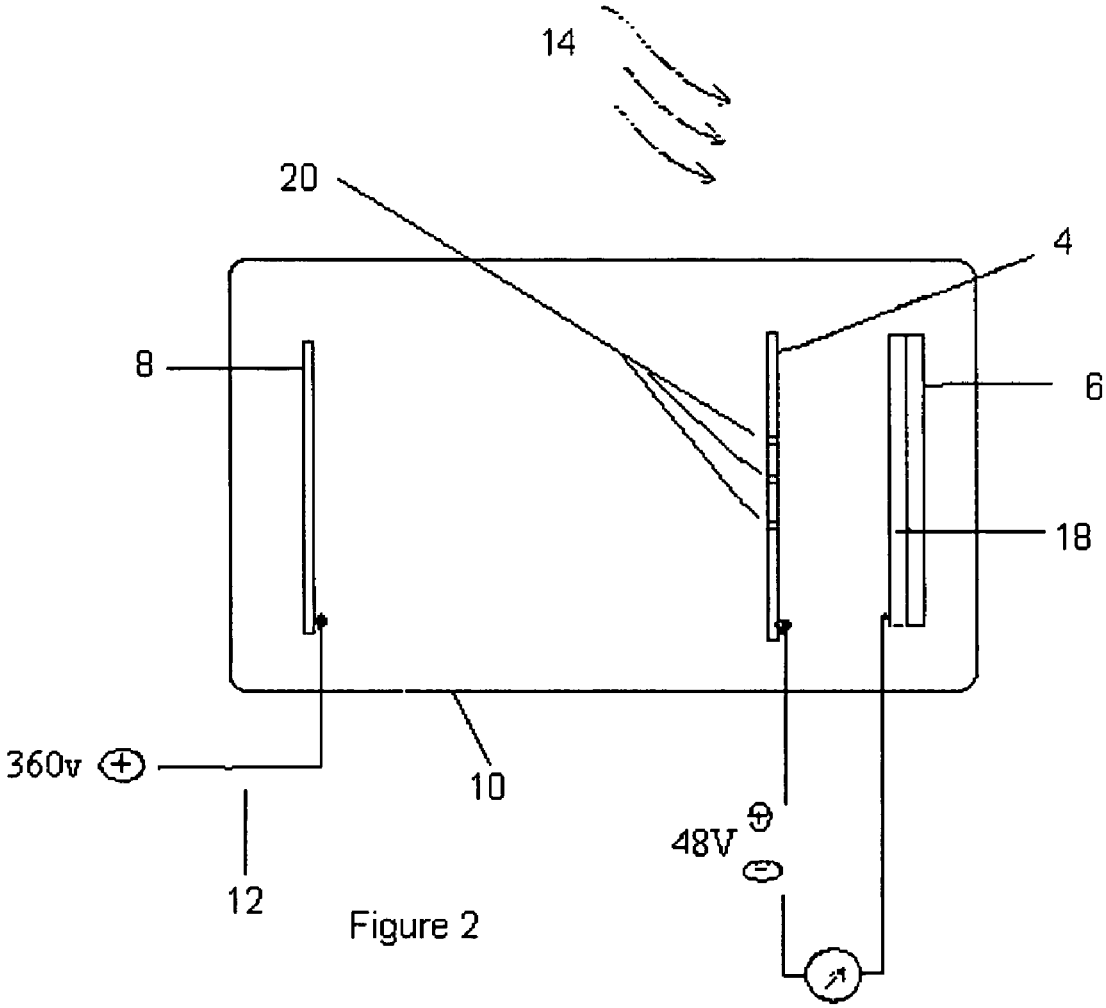
FIG. 2 is a schematic view of the electron emitter of Experiment 1.

Experiment 1:

As depicted in FIG. 2, a first prototype electron emitter device was assembled in the following configuration:

- the accelerator plate 8 was positioned a distance of approximately 3.0 cm from the collector plate 4;
- the accelerator plate 8 was positioned approximately 0.5 cm from the sides of the vacuum chamber 10;
- the collector plate 4 was positioned approximately 0.5 cm from the photocell 6;
- the collector plate 4 was provided with holes 20 therein to allow additional light to reach the photocell;
- the vacuum chamber is comprised of glass with a metallic lid; and
- the light 14 is provided by a light bulb operating with 2 AAA batteries, delivering 3 volts.

Under these conditions, no current was detected with a voltmeter connected between the photocell and the collector plate. Conclusions drawn that other vacuum and accelerating voltages may be required to produce current, and the holes in the electron collector may need to be removed.

Figure 3:
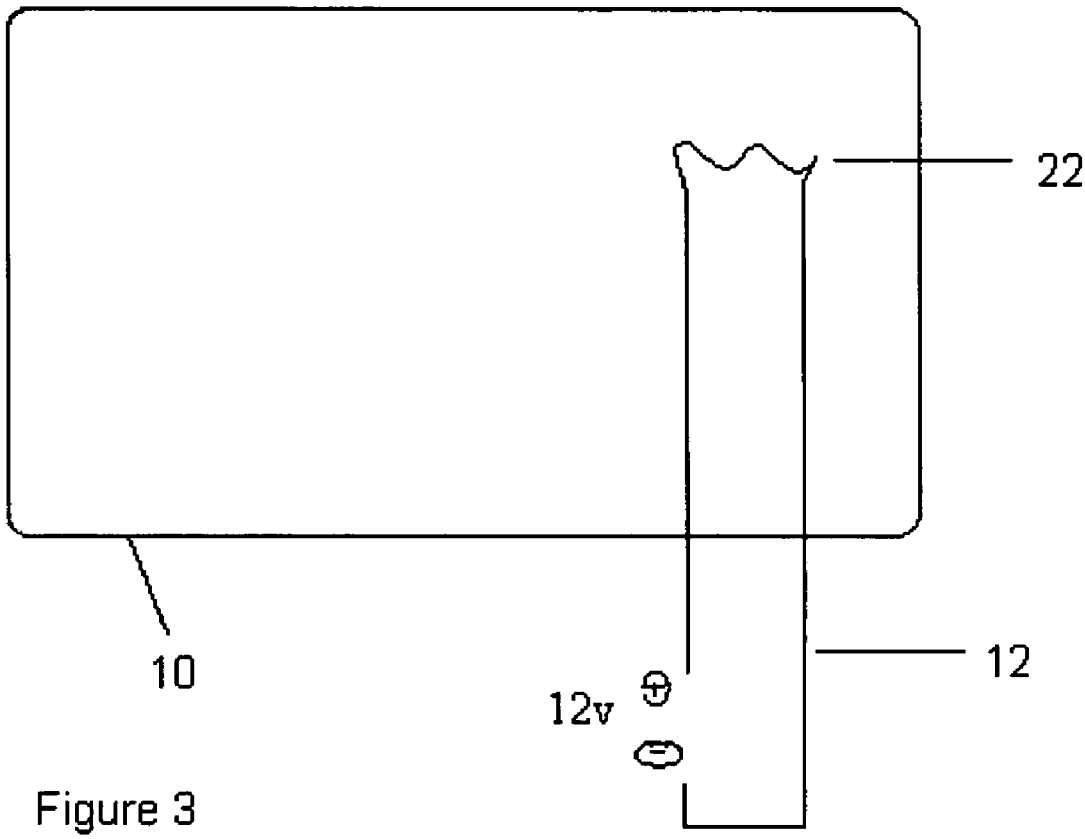
FIG. 3 is a schematic view of the electron emitter of Experiment 2.

Experiment 2:

As depicted in FIG. 3, the amount of vacuum required to produce a vacuum comparable to an automobile headlamp bulb was determined in the following configuration:

a filament 22 from an automobile headlamp was connected to a 12 volt power source 12 within a vacuum chamber 10 having a vacuum of 15 inches HgV at a first setting and 23 inches HgV at a second setting.

Under these conditions, at a vacuum of 15 inches, the filament burnt out upon connection to the power source. At a vacuum of 23 inches, the filament burned brightly for 4 seconds, producing bright light and smoke. It was concluded that the prototype will require a higher vacuum than used in Experiment 1.

Experiment 3:

The first prototype of Experiment 1 was connected to the vacuum tube socket of a vacuum tube radio. Under these conditions, no current was detectable with a voltmeter. It was concluded either that the accelerating voltage would need to be higher than that used with a standard vacuum tube or that the vacuum in the vacuum chamber was not sufficient relative to that of a standard vacuum tube.

Figure 4:
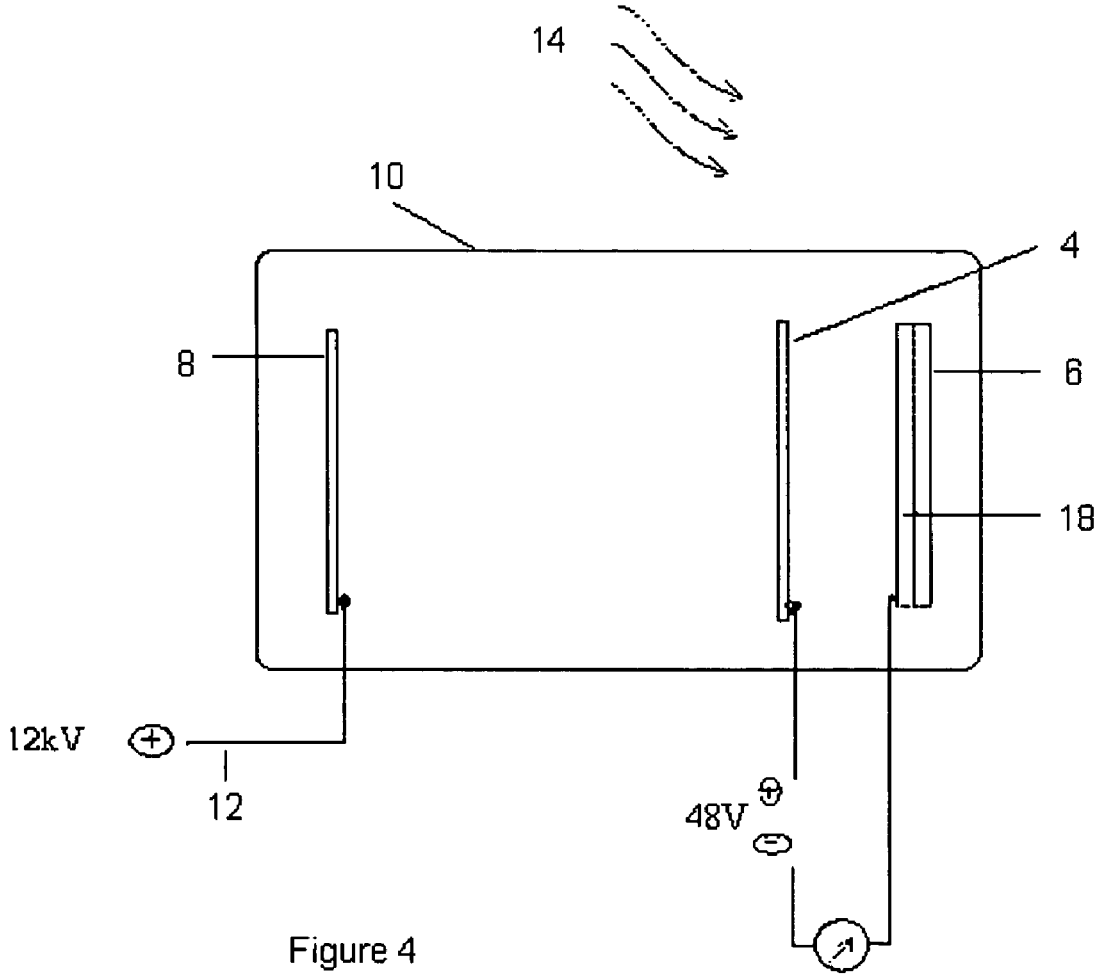
FIG. 4 is a schematic view of the electron emitter of Experiment 4.

Experiment 4:

As depicted in FIG. 4, a second prototype electron emitter device was assembled in the following configuration:

the accelerator plate 8 was positioned a distance of approximately 3.0 cm from the collector plate 4;

the accelerator plate 8 was positioned approximately 0.5 cm from the sides of the vacuum chamber 10;

the collector plate 4 was positioned approximately 0.5 cm from the photocell 6;

the vacuum chamber is comprised of glass with a metallic lid; and the light 14 is provided by a light bulb operating with 2 AAA batteries, delivering 3 volts.

Under these conditions, electric current was detected with a voltmeter connected between the photocell and the collector plate. The value of the electric current was dependant on the distance of the light source from the photocell. A current of 0.47 mA was produced with the light source approximately 4.0 cm from the photocell surface.

It was concluded that there was electrical leakage from the accelerator plate through the metallic lid of the vacuum chamber and the lid material should be non-conducting plastic. It was further concluded that the distance between the accelerator plate and the collector plate should be increased to avoid electric arching between the accelerator plate and the collector plate.

Figure 5:
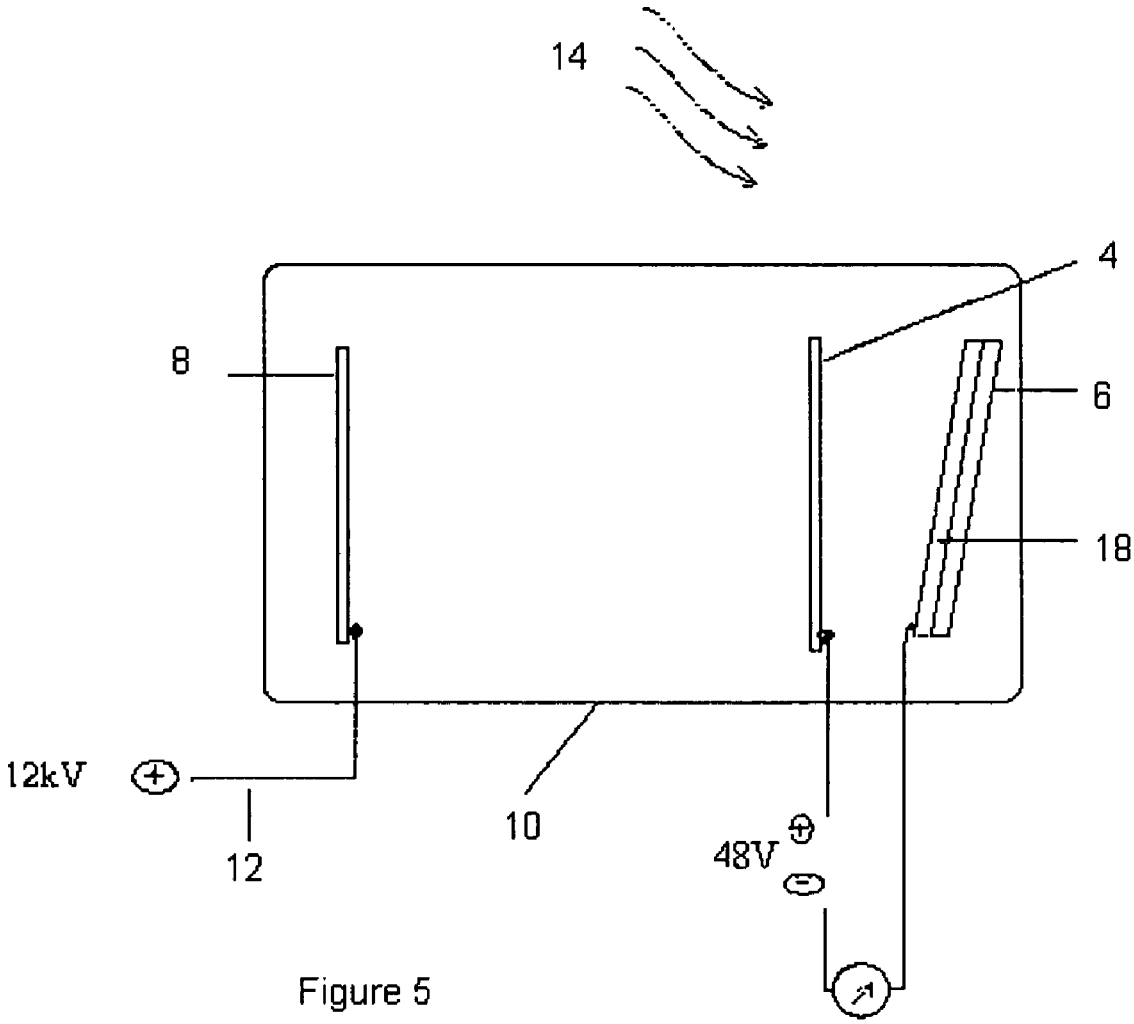
FIG. 5 is a schematic view of the electron emitter of Experiment 5.

Experiment 5:

As depicted in FIG. 5, a third prototype electron emitter device was assembled in the following configuration:

the accelerator plate was positioned a distance of approximately 6.0 cm from the collector plate 4;

the accelerator plate 8 was positioned approximately 1.5 cm from the sides of the vacuum chamber 10;

the collector plate 4 was positioned approximately 1.0 cm from the photocell 6;

the dimensions of the collector plate were selected such that a line between any point on the photocell 6 and any point on the accelerator plate 8 would pass through the collector plate 4;

the photocell was positioned at an incline relative to the collector plate to permit greater exposure to the incoming light from the light source;

the vacuum chamber is comprised of glass with a plastic lid; and the light 14 is provided by a light bulb operating with 2 AAA batteries, delivering 3 volts.

Under these conditions, electric current was detected with a voltmeter connected between the photocell and the collector plate. The value of the electric current was dependant on the distance of the light source from the photocell. A current of 0.76 mA was produced with the light source approximately 2.0 cm from the photocell surface. A current of 0.47 mA was produced with the light source approximately 4.0 cm from the photocell surface. A current of 0.22 mA was produced with the light source approximately 8.0 cm from the photocell surface.

It was concluded that the electric current could be increased by using a more powerful light source which would produce more intense light at constant rates. As the light source was operating on battery power, the light produced become dimmer after some time of operation as the battery power was drawn down.

Several modifications of the device described are considered to be within the scope of the invention. For example, the light source may be positioned within the vacuum chamber or outside of it, provided the light is able to expose the photosensitive side of the photocell. The light source could be embedded within the photosensitive side of the photocell.

The light source may be a light emitting diode. The light could be of any colour of the visible spectrum, or infrared light, provided that the wavelength of light is selected to excite the electrons in the photocell.

With respect to the accelerator plate, the distance between the accelerator plate and collector plate could be reduced and the voltage connected to the accelerator plate lowered, provided that the vacuum in the vacuum chamber was correspondingly increased.

In the preferred embodiment, the space between the accelerator plate and collector plate comprises a vacuum. Alternatively, the accelerator plate and collector plate may be separated by a glass sheet. In such an embodiment, the accelerator plate may comprise a conductive transparent coating.

With respect to the collector plate, the voltage connected to the collector plate may be varied. The collector plate may be comprised of a material appropriate to the application used. For example, a collector plate comprising a phosphorous coating on glass could be used for a television display monitor. A tungsten plate may be used for production of x-rays. In another embodiment, the collector plate may comprise a specimen to be examined, as in an electron microscope.

The distance between the collector plate and the photocell may be reduced, provided this does not result in the collector plate preventing the light from the light source from reaching the photosensitive side of the photocell. The space between the collector plate and the photocell may be a vacuum, or it may be filled with an electron multiplier, such as a microchannel plate, to increase the electron output of the device.

It will be appreciated by those skilled in the art that other variations of the preferred embodiment may also be practised without departing from the scope of the invention.

The invention claimed is:

1. An electron emitter device comprising:

a. a photocell having at least one photosensitive side;

an electron accelerator having a first adjustable potential difference applied thereto;

an electron collector having a second adjustable potential difference applied thereto, the electron collector disposed between the photosensitive side of the photocell and the electron accelerator;

a non-metallic vacuum chamber having an adjustable vacuum containing the photocell, the electron accelerator and the electron collector; and a light source positioned to provide light of a wavelength selected to excite electrons on the photosensitive side of the photocell, wherein the light source is embedded within the photocell.

2. An electron emitter device comprising:

a photocell having at least one photosensitive side;

an electron accelerator having a first adjustable potential difference applied thereto;

an electron collector having a second adjustable potential difference applied thereto, the electron collector disposed between the photosensitive side of the photocell and the electron accelerator;

a non-metallic vacuum chamber having an adjustable vacuum containing the photocell, the electron accelerator and the electron collector; and a light source positioned to provide light of a wavelength selected to excite electrons on the photosensitive side of the photocell, wherein the first adjustable potential difference accelerator voltage is at least 12 KV when the vacuum does not exceed 23 inches HgV.

* * * * *